US011069213B2

(12) United States Patent
Widgren et al.

(10) Patent No.: US 11,069,213 B2
(45) Date of Patent: Jul. 20, 2021

(54) FALL DETECTION SYSTEM AND METHOD

(71) Applicant: Pink Nectarine Health AB, Stockholm (SE)

(72) Inventors: Anders Widgren, Stockholm (SE); Tobias Linghammar, Enebyberg (SE)

(73) Assignee: PINK NECTARINE HEALTH AB, Stockholm (SE)

( * ) Notice: Subject to any disclaimer, the term of this patent is extended or adjusted under 35 U.S.C. 154(b) by 0 days.

(21) Appl. No.: 17/257,957

(22) PCT Filed: Jul. 6, 2018

(86) PCT No.: PCT/EP2018/068426

§ 371 (c)(1),
(2) Date: Jan. 5, 2021

(87) PCT Pub. No.: WO2019/008162

PCT Pub. Date: Jan. 10, 2019

(65) Prior Publication Data

US 2021/0174663 A1 Jun. 10, 2021

(30) Foreign Application Priority Data

Jul. 7, 2017 (SE) ..... 1750903-5

(51) Int. Cl.
*G08B 21/04* (2006.01)

(52) U.S. Cl.
CPC ..... *G08B 21/0446* (2013.01); *G08B 21/043* (2013.01)

(58) Field of Classification Search
CPC ..... G08B 21/0446
See application file for complete search history.

(56) References Cited

U.S. PATENT DOCUMENTS 7,893,844 B2 * 2/2011 Gottlieb ..... G08B 21/0446 340/573.1
2010/0052896 A1 * 3/2010 Goodman ..... G08B 21/0446 340/539.11

(Continued)

FOREIGN PATENT DOCUMENTS

WO WO-2010/037564 A1 4/2010
WO WO-2010/055450 A1 5/2010
WO WO-2011/055255 A1 5/2011

*Primary Examiner* — Travis R Hunnings
(74) *Attorney, Agent, or Firm* — Faegre Drinker Biddle & Reath LLP

(57) ABSTRACT

A fall detection system is provided, which includes at least one processing device, at least one personal module including a personal module pressure sensor, and at least one reference module including a reference module pressure sensor. The at least one processing device is arranged to receive personal pressure data from the at least one personal module pressure sensor, receive reference pressure data from the at least one reference module pressure sensor, determine a personal pressure using the personal pressure data and the reference pressure data, determine an individual personal pressure profile based on the historical personal pressure of the individual, compare the personal pressure with the individual personal pressure profile, which may e.g. be an individual personal pressure threshold, and set a fall detection alert based at least on whether the personal pressure lies beyond the individual personal pressure profile, e.g. by being above the individual personal pressure threshold.

22 Claims, 6 Drawing Sheets

(56) References Cited

U.S. PATENT DOCUMENTS

| | | | | |
|---|---|---|---|---|
| 2015/0025817 | A1* | 1/2015 | Ten Kate | G01L 7/00 702/50 |
| 2016/0038061 | A1* | 2/2016 | Kechichian | G08B 21/0446 600/301 |
| 2016/0253890 | A1* | 9/2016 | Rabinowitz | A61B 5/1113 340/539.13 |
| 2017/0000387 | A1* | 1/2017 | Forth | A61B 5/1117 |

* cited by examiner

FALL DETECTION SYSTEM AND METHOD

CROSS-REFERENCE TO PRIOR APPLICATIONS

This application is a § 371 National Stage Application of PCT International Application No. PCT/EP2018/068426 filed Jul. 6, 2018, which is incorporated herein in its entirety.

TECHNICAL FIELD

The present disclosure relates generally to fall detection systems and methods.

BACKGROUND

Elderly, sick or injured people may be prone to falling accidents. Since they may not have the strength or mobility to stand up after a fall has occurred, they may need help in such situations. This could be the case even if the fall itself has not caused any injury. It may therefore be desirable to monitor such an individual so that help can be dispatched when a fall has occurred.

US 2010/0052896 describes a fall detection system in which elderly, sick or injured people may be equipped with a wristband comprising a mobile barometric pressure sensor. The pressure sensor in the wristband communicates with a reference barometric pressure sensor installed at a known height (e.g. on a wall), which provides a reference pressure signal for the known height. The system comprises a processor that, based on the reference pressure of the reference pressure sensor, determines the absolute height of the mobile pressure sensor above the floor, and may activate an alarm if it is determined that the height of the mobile pressure sensor is below a predetermined threshold height.

U.S. Pat. No. 7,893,844 describes a fall detection system in which a resident carries a resident height detection device which can determine its height over the floor. The system may determine that a fall has occurred if the resident height detection device has remained within a predetermined threshold distance of the floor for more than a given period of time. A reference sensor may be mounted at a known height (e.g. on a wall) and provide a calibration signal to calibrate the height of the resident height detection device.

US 2015/0025817 describes a fall detection system in which elderly people carry a user device that determines a fall by comparing a height change of the user device with a threshold height change. The threshold height change can be adapted to the height at which the user wears or carries the user device.

Problems with the Prior Art

It is very difficult to accurately determine the absolute height of a pressure sensor above the floor. This means that systems relying on determining an absolute height will not be reliable.

Further, the movement pattern varies between individuals, and may also vary e.g. based on the layout of the house or apartment. For certain individuals in certain houses or apartments, it may e.g. be common to bend down close to the floor to e.g. fetch things from drawers which are located close to the floor. Absolute settings of threshold heights will therefore give many false alarms.

There is thus a need for an improved fall detection system.

SUMMARY

The above described problem is addressed by the claimed fall detection system. The system comprises at least one processing device, at least one personal module comprising a personal module pressure sensor, and at least one reference module comprising a reference module pressure sensor. The at least one processing device is arranged to receive personal pressure data from the at least one personal module pressure sensor, receive reference pressure data from the at least one reference module pressure sensor, determine a personal pressure using the personal pressure data and the reference pressure data, determine an individual personal pressure profile based on historical personal pressure data for the individual, compare the personal pressure with the determined individual personal pressure profile, and set a fall detection alert based at least on whether the personal pressure lies beyond the individual personal pressure profile. Since the individual personal pressure profile is determined based on historical personal pressure data for the individual, variations in movement pattern between different individuals and between different houses or apartments will be compensated, and the number of false alarms will be reduced.

In embodiments, the individual personal pressure profile comprises an individual personal pressure threshold, and the at least one processing device is arranged to set the fall detection alert based at least on whether the personal pressure is above the individual personal pressure threshold.

In embodiments, the at least one processing device is arranged to determine the personal pressure as an absolute personal pressure calculated based on the personal pressure data and the reference pressure data, and determine the individually determined personal pressure profile based on the historical absolute personal pressure of the individual.

In embodiments, the at least one processing device is arranged to determine the individual personal pressure profile based on the probability distribution of the historical personal pressure of the individual. These are simple yet reliable ways of determining the individual personal pressure profile.

In embodiments, the at least one processing device is arranged to determine the individual personal pressure profile in such a way that personal pressure values that lie beyond the individual personal pressure profile have less than a predetermined probability of occurring. The at least one processing device may e.g. be arranged to set the predetermined probability of occurring to 1-5%, such as e.g. 3%. This ensures that the system will not set fall detection alerts too often.

In embodiments, the at least one processing device is further arranged to input the personal pressure into a machine learning system that has been trained using historical personal pressures representing detected falls, and set the fall detection alert based also on whether this machine learning system classifies the personal pressure as a fall. The machine learning system may have been trained using historical personal pressures representing detected falls for the individual, or for many individuals.

In embodiments, the personal module further comprises a movement sensor, e.g. an accelerometer, and the at least one processing device is further arranged to analyze the signal from the movement sensor and set the fall detection alert based also on this signal. A fall may comprise a characteristic movement that can be detected by a movement sensor, which means that the signal from a movement sensor can be used to avoid false alarms.

In embodiments, the processing device is further arranged to send an alarm signal based on the fall detection alert. This may call the attention of people who may help the individual who has fallen, such as relatives and/or healthcare personnel.

In embodiments, the personal module further comprises a personal module communication interface, and the reference module further comprises a reference module communication interface, which are arranged to communicate with each other. This enables communication between the personal module and the reference module. The communication may take place via another unit, such as a remote processing arrangement, which may e.g. be comprised in a web server.

In embodiments, the system comprises a number of reference modules, and the at least one processing device is arranged to determine the personal pressure using reference pressure data from the reference module that is closest to the personal module. Since the reference pressure data should correspond as closely as possible to the personal pressure data, the reference pressure data should be collected as simultaneously as possible from the reference module that is closest to the personal module when the personal pressure data is collected.

The above described problem is further addressed by the claimed fall detection method. The method comprises receiving, in at least one processing device, personal pressure data from a personal module pressure sensor arranged in a personal module, receiving, in the at least one processing device, reference pressure data from a reference module pressure sensor arranged in a reference module, determining a personal pressure using the personal pressure data and the reference pressure data, determining an individual personal pressure profile, which may e.g. be an individual personal pressure threshold, based on the historical personal pressure of the individual, comparing the personal pressure with the individual personal pressure profile, and setting a fall detection alert based at least on whether the personal pressure lies beyond the individual personal pressure profile. Since the personal pressure profile is individually determined, the claimed method compensates for variations in movement pattern between different individuals and between different houses or apartments, and thus reduces the number of false alarms.

In embodiments, the individual personal pressure profile comprises an individual personal pressure threshold, and the method comprises setting the fall detection alert based at least on whether the personal pressure is above the individual personal pressure threshold.

In embodiments, the determining of the personal pressure comprises calculating the personal pressure as an absolute personal pressure based on the personal pressure data and the reference pressure data, and the determining of the individually determined personal pressure profile is based on the historical absolute personal pressure of the individual.

In embodiments, the method further comprises determining the individual personal pressure profile based on the probability distribution of historical personal pressure data for the individual. These are simple yet reliable ways of determining the individual personal pressure profile.

In embodiments, the method further comprises determining the individual personal pressure profile in such a way that personal pressure values that lie beyond the individual personal pressure profile have less than a predetermined probability of occurring. The predetermined probability of occurring may e.g. be 1-5%, such as e.g. 3%. This ensures that the system will not set fall detection alerts too often.

In embodiments, the method further comprises inputting the personal pressure into a machine learning system that has been trained using historical personal pressures representing detected falls, and the setting of the fall detection alert is based also on whether this machine learning system classifies the personal pressure as a fall. The machine learning system may have been trained using historical personal pressures representing detected falls for the individual, or for many individuals.

In embodiments, the method further comprises setting the fall detection alert based also on a signal from a movement sensor, e.g. an accelerometer, arranged in the personal module. A fall may comprise a characteristic movement that can be detected by a movement sensor, which means that the signal from a movement sensor can be used to avoid false alarms.

In embodiments, the method further comprises sending an alarm signal based on the fall detection alert. This may call the attention of people who may help the individual who has fallen, such as relatives and/or healthcare personnel.

In embodiments, the method further comprises communicating between the personal module and the reference module using a personal module communication interface and a reference module communication interface. The communication may take place via another unit, such as a remote processing arrangement, which may e.g. be comprised in a web server.

In embodiments, the method further comprises determining the personal pressure using reference pressure data from the reference module that is closest to the personal module. Since the reference pressure data should correspond as closely as possible to the personal pressure data, the reference pressure data should be collected as simultaneously as possible from the reference module that is closest to the personal module when the personal pressure data is collected.

The at least one processing device may be a personal module processing device, a reference module processing device, or another processing device, such as a remote processing device, which may e.g. be comprised in a web server and/or be cloud based. The at least one processing device may also be a combination of any number of processing devices, so that some of the processing takes place in one processing device and some of the processing takes place in one or more other processing devices. It is thus not necessary for all of the processing to take place in the same processing device.

The scope of the invention is defined by the claims, which are incorporated into this section by reference. A more complete understanding of embodiments of the invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present disclosure and their advantages are best understood by referring to the detailed description that follows. It should be appreciated that like reference numerals are used to identify like elements illustrated in one or more of the figures.

DETAILED DESCRIPTION

The present disclosure relates generally to fall detection systems and fall detection methods. Embodiments of the disclosed solution are presented in more detail in connection with the figures.

Figure 1:
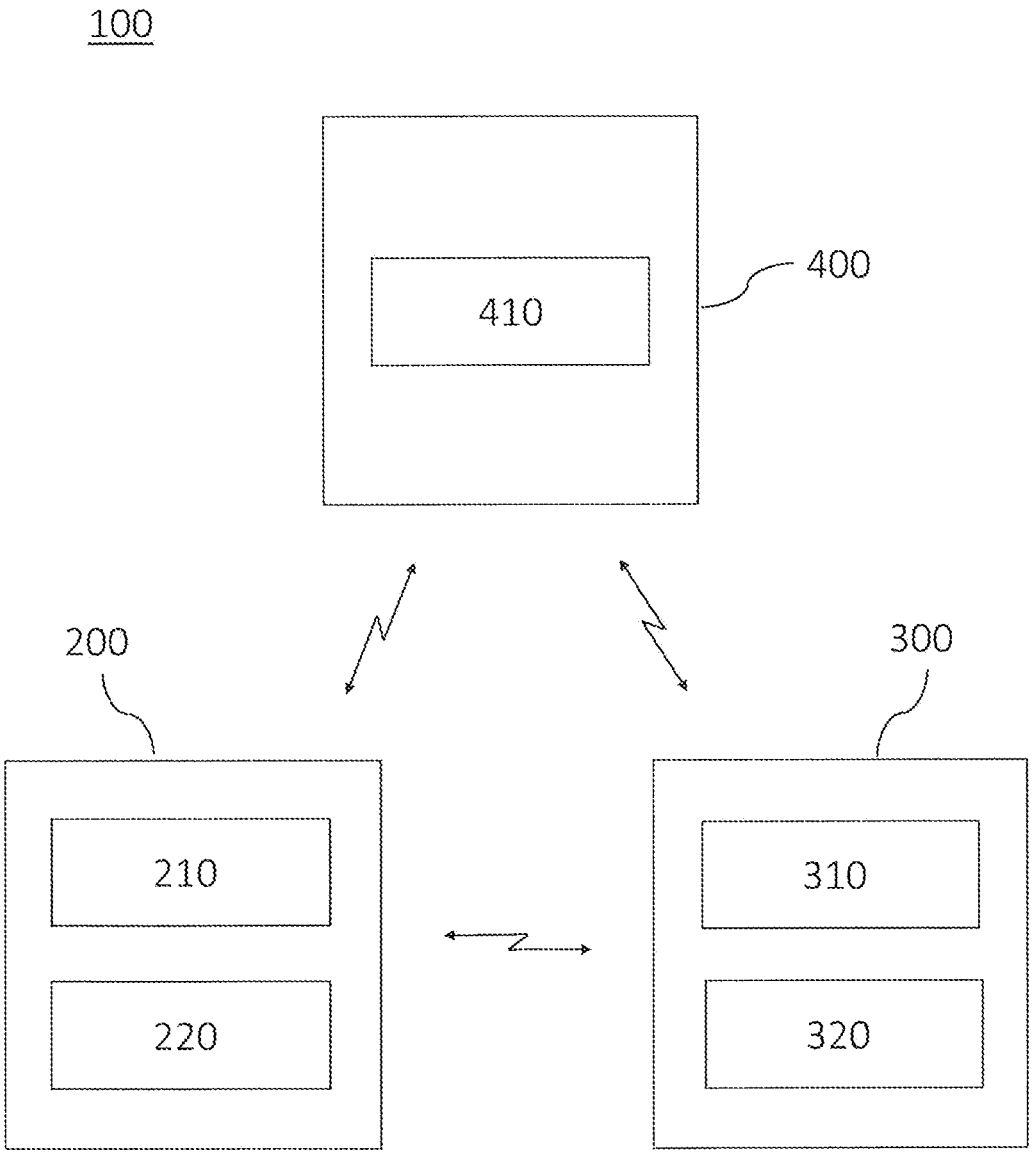
FIG. 1 is a schematic illustration of a fall detection system, in accordance with one or more embodiments described herein.

FIG. 1 is a schematic illustration of a fall detection system 100, in accordance with one or more embodiments described herein. The fall detection system 100 shown in FIG. 1 comprises a personal module 200, a reference module 300 and a remote processing arrangement 400, which are arranged to communicate with each other. For clarity, the system 100 is shown comprising only one personal module 200 and only one reference module 300, but the system may comprise any number of personal modules 200 and reference modules 300. In the embodiment shown in FIG. 1, the personal module 200 comprises a personal module processing device 210 and a personal module pressure sensor 220, the reference module 300 comprises a reference module processing device 310 and a reference module pressure sensor 320, and the remote processing arrangement 400 comprises a remote processing device 410.

Figure 2:
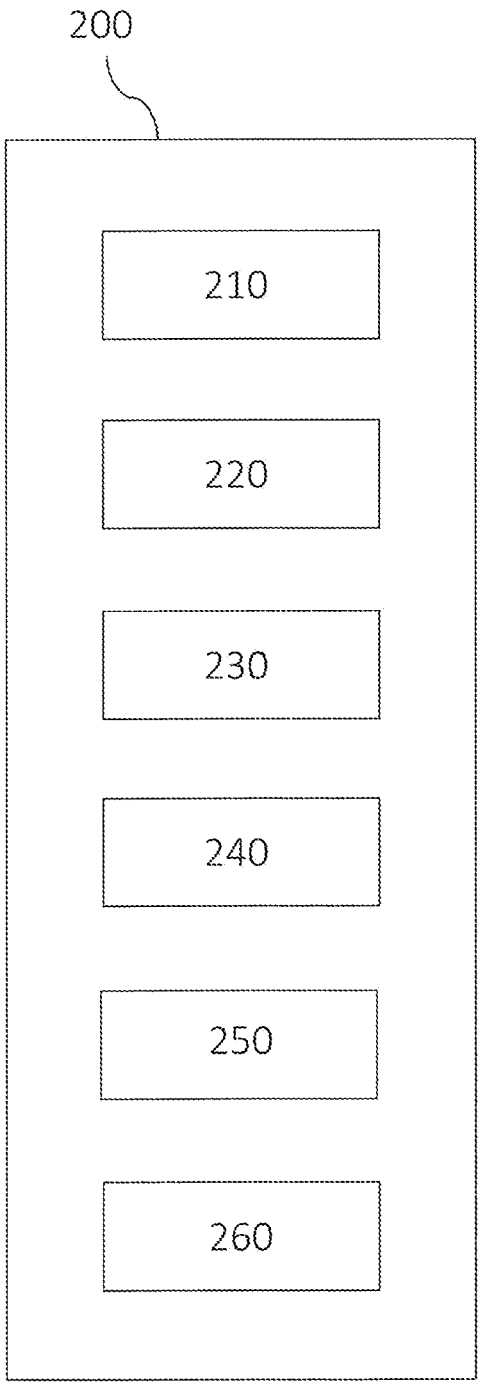
FIG. 2 is a schematic illustration of a personal module, in accordance with one or more embodiments described herein.

An embodiment of the personal module 200 is shown schematically in FIG. 2. The personal module 200 may be e.g. a wristband, a bracelet, a smartwatch, a necklace, a pendant, a smartphone, or anything else that can be carried by the individual to be monitored. The personal module 200 may comprise other sensors in addition to the personal module pressure sensor 220, such as e.g. a movement sensor 230 (e.g. an accelerometer) and/or a heart rate sensor 240, and/or other functionalities such as a GPS receiver 250. The personal module 200 may also include e.g. a microphone, a speaker, and/or a so called panic button. The personal module 200 may also include a battery.

Figure 3:
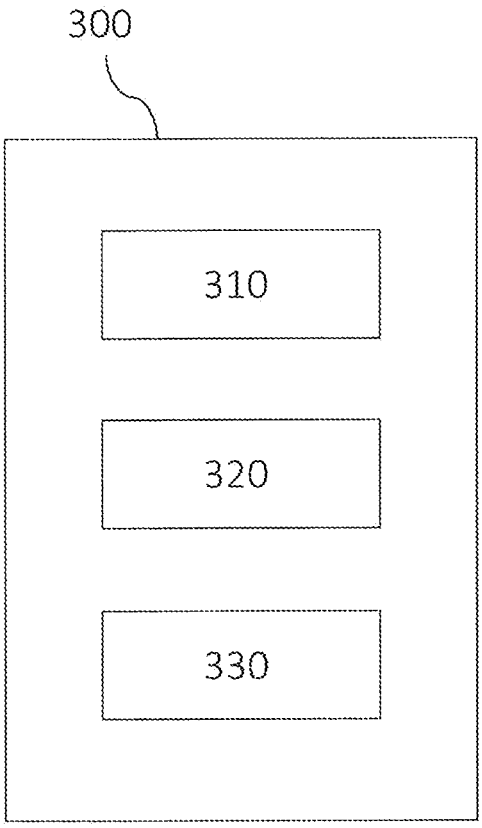
FIG. 3 is a schematic illustration of a reference module, in accordance with one or more embodiments described herein.

An embodiment of the reference module 300 is shown schematically in FIG. 3. The reference module 300 may be e.g. a unit that is mounted on the wall or in the ceiling. The reference module 300 may comprise a battery, or be supplied with electricity through being connected with the electrical system in the house or apartment.

The personal module pressure sensor 220 continuously senses personal pressure data that varies with the height of the personal module pressure sensor 220 as the individual moves. The personal pressure data from the personal module pressure sensor 220 is monitored, e.g. by the personal module processing device 210, in order to determine whether a fall has occurred. The personal pressure data may e.g. be in the form of a personal pressure signal from the personal module pressure sensor 220 that is sampled by the personal module processing device 210. In embodiments, the personal pressure data comprises the derivative of the personal pressure signal from the personal module pressure sensor 220, in order for the rate of change to be determined.

There are a number of factors that may cause rapid pressure changes that are of greater magnitude than the pressure change caused by a fall. The ambient pressure may change rapidly due to e.g. weather change, and the pressure in a room may change rapidly due to e.g. the opening or closing of a door or a window. The magnitude of such pressure changes may be greater than the pressure change caused by a fall (e.g. in the form of a drop of 0.5 m). In order to compensate for this, reference pressure data from the reference module pressure sensor 320 may be used together with the personal pressure data from the personal module pressure sensor 220 in the determination of a personal pressure $P_P$. The personal pressure $P_P$ may e.g. be the same as the personal pressure data from the personal module pressure sensor 220 as long as the reference pressure data from the reference module pressure sensor 320 is considered to be "normal", e.g. by not changing too rapidly or deviating too much from nominal reference pressure values. When the reference pressure data from the reference module pressure sensor 320 is not considered to be "normal", the personal pressure $P_P$ may e.g. be disregarded. It may be enough to make this determination only if the personal pressure $P_P$ lies beyond the individual personal pressure profile, in order to prevent erroneous fall detection alerts.

Another option is to determine the personal pressure $P_P$ as an absolute personal pressure PA calculated based on the personal pressure data from the personal module pressure sensor 220 and reference pressure data from the reference module pressure sensor 320. Since the reference pressure data will vary with the pressure changes in the room, calculating an absolute personal pressure PA based on the personal pressure data and the reference pressure data will eliminate any personal pressure changes due to pressure changes in the room. It may be enough to calculate the absolute personal pressure PA only if the personal pressure $P_P$ lies beyond the individual personal pressure profile, in order to prevent erroneous fall detection alerts. The reference pressure data may e.g. be in the form of a reference pressure signal from the reference module pressure sensor 320 that is sampled by the reference module processing device 310. In embodiments, the reference pressure data comprises the derivative of the reference pressure signal from the reference module pressure sensor 320, in order for the rate of change to be determined.

The personal pressure $P_P$ may be compared with an individual personal pressure profile, which may e.g. be in the form of an individual personal pressure threshold $P_T$, and a fall detection alert be set only if the personal pressure $P_P$ lies beyond the individual personal pressure profile, e.g. by being above the individual personal pressure threshold $P_T$. The setting of a fall detection alert may e.g. involve changing the value of a fall detection parameter or flag. The individual personal pressure profile may be determined in a variety of ways, e.g. based on the historical personal pressure $P_P$ for the individual, that may e.g. be stored in a memory. Since the individual personal pressure profile is individually determined, variations in movement pattern between different individuals and between different houses or apartments will be compensated, and the number of false alarms will be reduced.

The fall detection alerts may be used for various purposes. The obvious purpose is to send an alarm signal to call the attention of people who may help the individual who has fallen, such as relatives and/or healthcare personnel. Such an alarm signal may be sent e.g. to a mobile device such as a smartphone, or a multipurpose healthcare alarm system. The system may comprise different levels of alarms based e.g. on the certainty of the fall detection, so that high level alarms are immediately sent out to all relevant parties while low level alarms are routed differently.

The individual who has fallen may not always require help, but it may still be useful to collect information about detected falls. Individuals who fall often may e.g. have health related problems which relatives and/or healthcare personnel may wish to investigate further. Information about detected falls may therefore be stored in a memory for further analysis.

Figure 4:
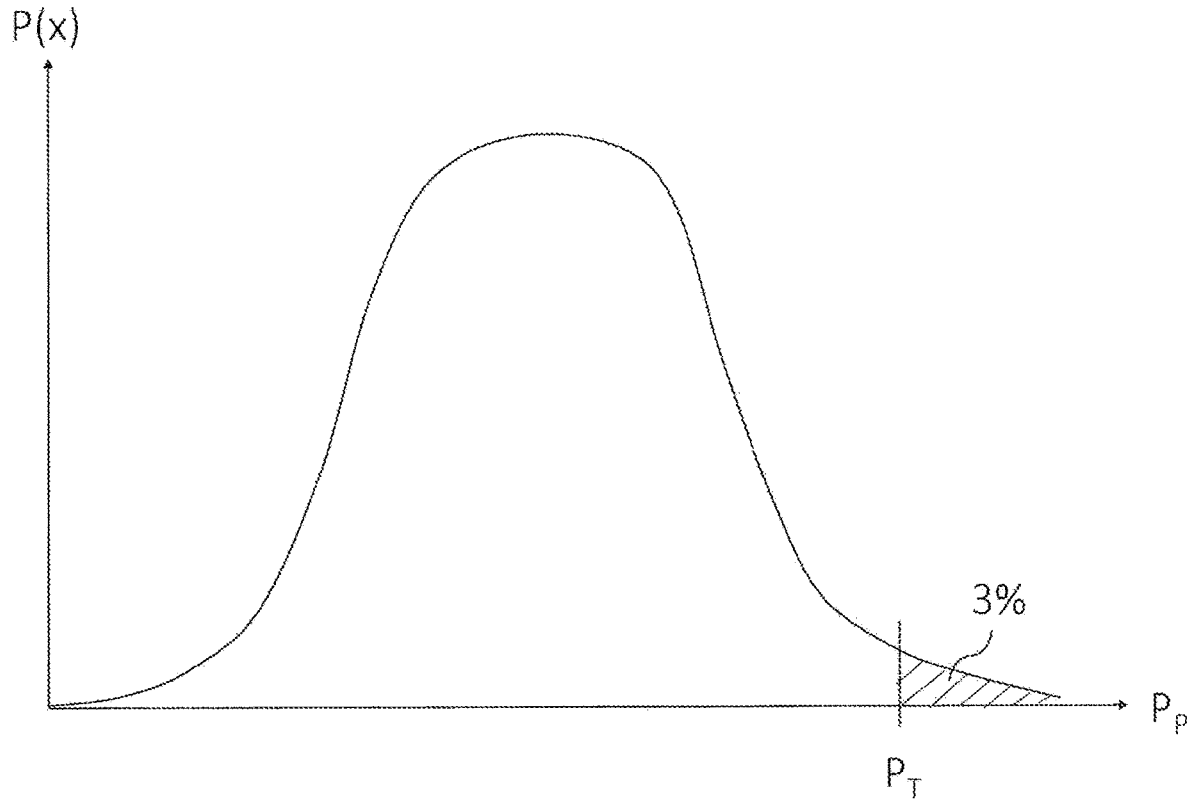
FIG. 4 shows a schematic example of a probability distribution curve for personal pressure data.

FIG. 4 shows a schematic example of a probability distribution curve for the personal pressure $P_P$ of an individual. When enough personal pressure data has been collected for the individual, the personal pressure $P_P$ may be analyzed and arranged using a probability distribution curve, e.g. using histogram functionality. It can then be determined how often the personal pressure $P_P$ lies within various pressure ranges. The individual personal pressure profile used in a fall detection may then be based on the probability distribution of the historical personal pressure $P_P$ for the individual, by e.g. determining a threshold $P_T$ in such a way that personal pressure values $P_P$ that are higher than the threshold $P_T$ have less than a predetermined probability of occurring. This is a simple yet reliable way of determining the individual personal pressure profile.

The predetermined probability is preferably set to avoid too many false alarms, e.g. at 1-5% probability of occurring, such as at e.g. 3% probability of occurring. This is in FIG. 4 illustrated with a threshold line marking the point where 3% of the probability under the probability distribution curve lies above the threshold $P_T$, and ensures that the system will not set fall detection alerts too often. However, for an individual who falls often, the threshold line should preferably be moved to the left in the curve, such as to a point where e.g. 8% or 10% of the probability under the probability distribution curve lies above the threshold $P_T$, to ensure that all falls are detected.

In the schematic example of a probability distribution curve for the personal pressure $P_P$ shown in FIG. 4, the threshold $P_T$ has been set to discriminate only personal pressures $P_P$ that are higher than the threshold $P_T$. If the threshold $P_T$ is set just to discriminate personal pressures $P_P$ having a low probability of occurring, also unusually low personal pressures $P_P$ will be detected. This is usually less relevant, since unusually low personal pressures $P_P$ occur when the personal module is located higher up than it usually is, such as e.g. when the individual is raising the arm. This is normally not associated with a fall. It is thus advantageous to discriminate only personal pressures $P_P$ that are higher than the predetermined threshold $P_T$.

The individual personal pressure profile may be in the form of an individual personal pressure threshold $P_T$, but it may also take other forms. If large amounts of historical personal pressure $P_P$ values for an individual are fed into a machine learning system together with information about e.g. historical personal pressure $P_P$ values indicating a fall, the machine learning system may determine an individual personal pressure profile which is more complex than an individual personal pressure threshold $P_T$, but which may still be used to determine whether a specific personal pressure $P_P$ indicates a fall. Such a machine learning algorithm may in this case also use other data than the historical personal pressure $P_P$ values for the individual in order to determine the individual personal pressure profile. The individual personal pressure profile may e.g. be in the form of a range or pattern of "normal" personal pressure $P_P$ values, and may include also "normal" rates of change of the personal pressure $P_P$, e.g. based on the derivative of the personal pressure signal from the personal module pressure sensor 220. The comparison of the personal pressure $P_P$ with the individual personal pressure profile may involve comparing the personal pressure $P_P$ over a certain time span with a pattern of "normal" personal pressure $P_P$ values.

A machine learning system may also be trained using historical personal pressures representing detected falls for many individuals. In this case, the fall detection alert may be set based on the comparison of the personal pressure $P_P$ with the individual personal pressure profile, together with whether the machine learning system classifies the personal pressure $P_P$ as a fall based on historical personal pressures representing detected falls for many individuals. For this comparison, the personal pressure $P_P$ may first be normalized, e.g. by deducting the average and dividing by the standard deviation.

If the personal module 200 comprises additional sensors in addition to the personal module pressure sensor 220, such as e.g. a movement sensor 230 (e.g. an accelerometer) and/or a heart rate sensor 240, the fall detection alert may be based also on signals from these sensors. A fall may comprise a characteristic movement, e.g. in the form of a characteristic sequence of motion and postures. If a large amount of data is analyzed, e.g. using machine learning, e.g. in a so called self-learning system, typical signal patterns corresponding to a fall may be determined. These signal patterns may be detected by a movement sensor, which means that the signal from a movement sensor can be used to avoid false alarms. In the same way, the analysis of a signal from a heart rate sensor 240 can also be used to avoid false alarms. If e.g. the heart rate does not change although the personal pressure $P_P$ indicates a fall, it is likely that a fall has not occurred.

The fall detection system 100 may thus comprise at least one processing device 210, 310, 410, at least one personal module 200 comprising a personal module pressure sensor 220, and at least one reference module 300 comprising a reference module pressure sensor 320. The at least one processing device 210, 310, 410 may be arranged to receive personal pressure data from the at least one personal module pressure sensor 220, receive reference pressure data from the at least one reference module pressure sensor 320, determine a personal pressure $P_P$ using the personal pressure data and the reference pressure data, determine an individual personal pressure profile, which may e.g. be an individual personal pressure threshold $P_T$, based on the historical personal pressure $P_P$ for the individual, compare the personal pressure $P_P$ with the individual personal pressure profile, and set a fall detection alert based at least on whether the personal pressure $P_P$ lies beyond the individual personal pressure profile, e.g. by being above the individual personal pressure threshold $P_T$. Since the individual personal pressure profile is individually determined, variations in movement pattern between different individuals and between different houses or apartments will be compensated, and the number of false alarms will be reduced.

It is not necessary for the system 100 to comprise any remote processing arrangement 400—it is perfectly possible for all the processing to take place in the personal module processing device 210 and/or in the reference module processing device 310. In the same way, it is not necessary for the personal module 200 to comprise a personal module processing device 210, or for the reference module 300 to comprise a reference module processing device 310, if the system comprises a remote processing arrangement 400 and all the processing takes place in the remote processing device 410. The system thus only needs to comprise one processing device 210, 310, 410, but may also comprise several processing devices 210, 310, 410 working together.

The personal module 200 may comprise a personal module communication interface 260, and the reference module 300 may comprise a reference module communication interface 330, which are arranged to communicate with each other. This enables communication between the personal module 200 and the reference module 300, so that a personal pressure $P_P$ can be determined using personal pressure data form the personal module pressure sensor 220 and reference pressure data from the reference module pressure sensor 320. In order for this determination to take place in the personal module processing device 210, the reference pressure data must first be received from the reference module pressure sensor 320 in the personal module processing device 210, and this requires a communication interface between the personal module 200 and the reference module 300. In order for this determination to take place in the reference module processing device 310, the reference pressure data must first be received from the personal module pressure sensor 220 in the reference module processing device 310, and this also requires a communication interface between the personal module 200 and the reference module 300. However, this determination may also take place in a remote processing device 410, which may e.g. be comprised in a web server, and in such a case a communication interface to the remote processing arrangement 400 is required, either directly from each of the personal module 200 and the reference module 300, or e.g. from just one of them, if there is a communication interface between them. The communication between all of the units in the system may thus take place either directly or indirectly, via other units. For example, if each of the personal module 200 and the reference module 300 has a communication interface with a remote processing arrangement 400, they may communicate with each other via the remote processing arrangement 400.

The personal module 200 may comprise additional functionalities, such as e.g. a GPS receiver 250. This may be used to determine the location of the personal module 200. The fall detection alert may then be based also on input from the GPS receiver 250. It may e.g. be determined through analysis of historical data in which parts of the house or apartment that a fall is most likely to occur, and this may be used as input into the setting of the fall detection alert. Input from the GPS receiver 250 may also be used to discriminate a person walking down a staircase from a person falling, e.g. based on the speed of downwards movement. Further, input from the GPS receiver 250 may be used to set the severity of the fall detection alert, so that if it is e.g. determined that a fall has occurred in an area containing a staircase, the fall detection alert is set as severe, and alarms are immediately sent out.

The location of the personal module 200 may also be determined in other ways than using a GPS receiver 250, such as e.g. based on from which reference modules 300 signals are received.

Additional sensors 230, 240, 250 in the personal module 200 may also be used to set the severity of the fall detection alert, which may be used to adapt the level of alarms sent out. If the signals from all sensors indicate a fall, the fall detection alert may be set to be severe and high level alarms be immediately sent out to all relevant parties, but if the personal pressure $P_P$ indicates a fall but all other sensors are normal, the fall detection alert may be set to be less severe and just indications be sent to various designated systems. The additional sensors 230, 240, 250 may e.g. be a movement sensor (e.g. an accelerometer), a heart rate sensor, a GPS receiver, or sensors for blood pressure and/or galvanic skin response. The time during which the personal pressure $P_P$ has been beyond the individual personal pressure profile may also be determined. Information from many different sensors may be combined and analyzed, e.g. using machine learning or artificial intelligence, e.g. in order to set the severity of the fall detection alert.

To ensure correspondence between pressure readings from a personal module pressure sensor 220 and a reference module pressure sensor 320, a reference module 300 may be installed in each room that the individual wearing the personal module 200 has access to. The personal pressure data is in this case preferably compared with reference pressure data from the reference pressure sensor 320 that is located in the same room as the individual carrying the personal module 200. Further, the pressure may in some situations also vary within a room due to e.g. size and architecture, and in such cases it may be desirable to install multiple reference modules 300 in a room. The personal pressure data is in this case preferably compared with reference pressure data from the reference pressure sensor 320 that is closest to the individual carrying the personal module 200. Since the reference pressure data should correspond as closely as possible to the personal pressure data, the reference pressure data should be collected as simultaneously as possible from the reference module 300 that is closest to the personal module 200 when the personal pressure data is collected. The determination of which reference module 300 that is closest may e.g. be done in the personal module processing device 210 using e.g triangulation of signals from several reference modules 300, in any of the processing devices 210, 310, 410 using the GPS receiver 250 of the personal module 200 and known locations of the reference modules 300, or by analyzing the relative strength of signals received from the reference modules 300 in the personal module 200. The determination may include pairing the personal module 200 with the reference module 300 that is closest to the personal module 200 in ways known in the art.

Figure 5:
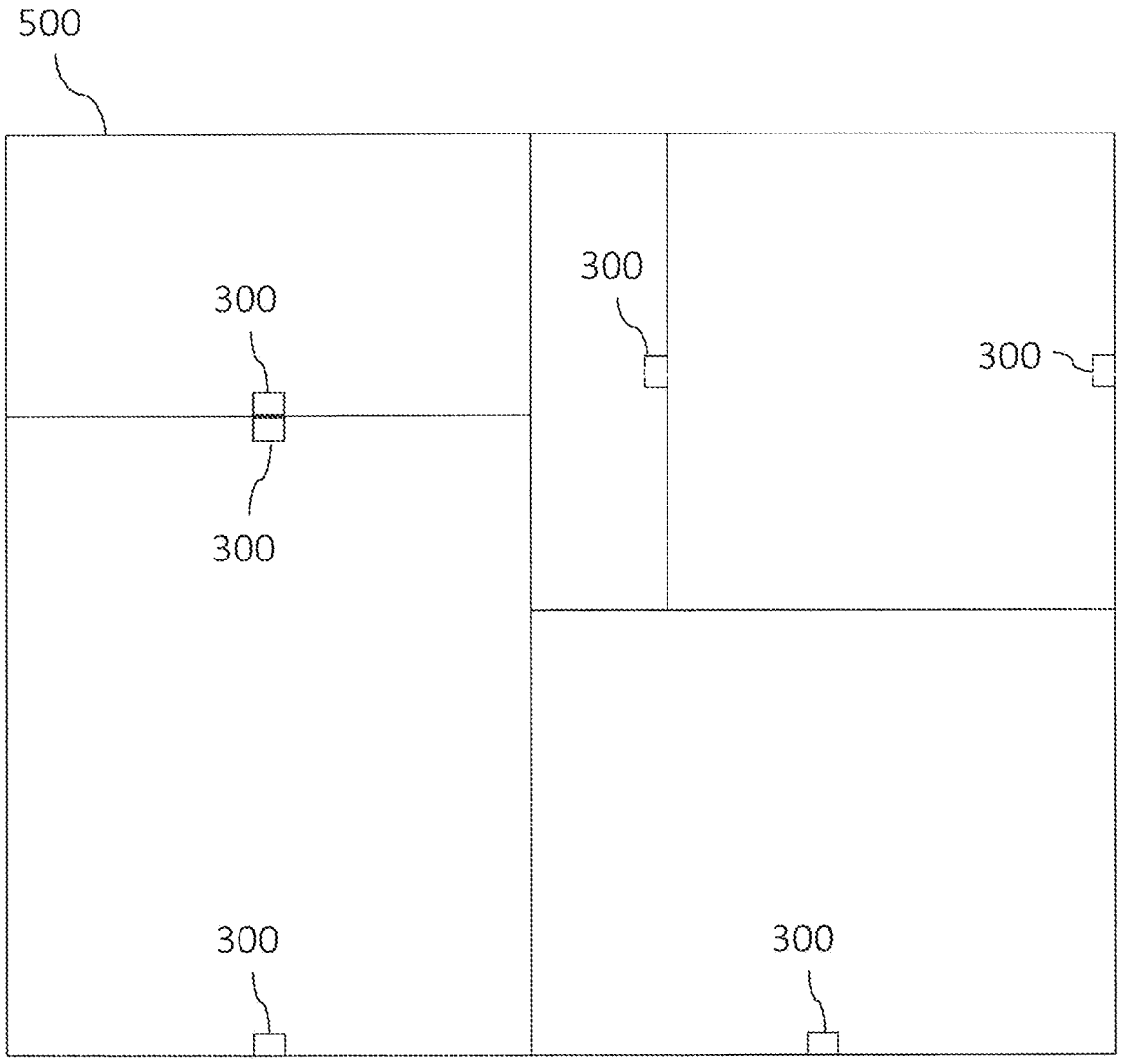
FIG. 5 schematically shows an example of a house or an apartment where a fall detection system comprising a number of reference modules has been installed.

FIG. 5 schematically shows an example of a house or an apartment 500 where a fall detection system 100 comprising a number of reference modules 300 has been installed. In the example shown, each room comprises at least one reference module 300, and the largest room comprises two reference modules 300. It is of course not necessary for each room to comprise a reference module 300, although this increases the sensitivity and reliability of the fall detection system 100. The reference modules 300 may be installed in any suitable position, such as e.g. mounted on the walls and/or in the ceiling. If the house or apartment 500 comprises more than one level or floor, there should be reference modules 300 installed on each level or floor. If an individual carrying the personal module 200 moves between the floors, e.g. down a staircase, the system should compensate for this, so that fall detection alerts are not set each time the individual walks down the staircase. This may e.g. be done by determining the position of the personal module 200, e.g. using a GPS receiver 250. Alternatively, the speed of change of the personal pressure $P_P$ may be used, e.g. by analyzing the derivative of the personal pressure $P_P$.

Any appropriate algorithm may be used for the setting of a fall alert based on the combination of the determination of whether the personal pressure $P_P$ lies above the individual personal pressure profile with data from other sensors.

Figure 6:
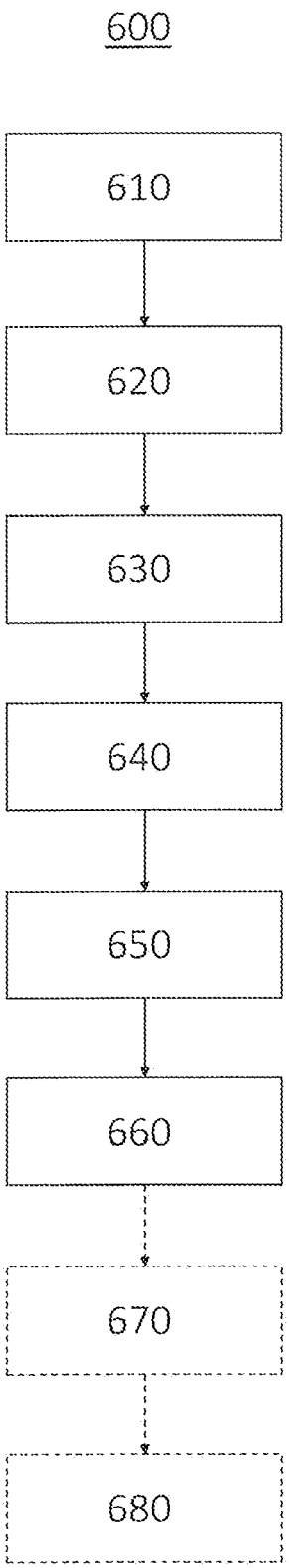
FIG. 6 schematically shows a fall detection method, in accordance with one or more embodiments described herein.

FIG. 6 schematically shows a fall detection method 600, in accordance with one or more embodiments described herein. The fall detection method 600 may include the following steps (not necessarily in this order):

Step 610: receiving, in at least one processing device 210, 310, 410, personal pressure data from a personal module pressure sensor 220 arranged in a personal module 200.

Step 620: receiving, in the at least one processing device 210, 310, 410, reference pressure data from a reference module pressure sensor 320 arranged in a reference module 300.

Step 630: determining a personal pressure $P_P$ using the personal pressure data and the reference pressure data.

Step 640: determining an individual personal pressure profile based on the historical personal pressure $P_P$ for the individual.

Step 650: comparing the personal pressure $P_P$ with the individual personal pressure profile; and Step 660: setting a fall detection alert based at least on whether the personal pressure $P_P$ lies beyond the individual personal pressure profile.

If there is more than one reference module 300 in the system, the determining 630 of the personal pressure $P_P$ may use reference pressure data from the reference module 300 that is closest to the personal module 200.

The individual personal pressure profile may comprise an individual personal pressure threshold $P_T$, and the setting 660 of the fall detection alert may in this case be based at least on whether the personal pressure $P_P$ is above the individual personal pressure threshold $P_T$.

The determining 630 of the personal pressure $P_P$ may e.g comprise calculating the personal pressure $P_P$ as an absolute personal pressure PA based on the personal pressure data and the reference pressure data, and the determining 640 of the individual personal pressure profile may e.g. be based on the historical absolute personal pressure PA for the individual.

The personal pressure $P_P$ may e.g. be determined 630 using reference pressure data from the reference module 300 that is closest to the personal module 200.

The fall detection method 600 may further include:

Step 670: inputting the personal pressure $P_P$ into a machine learning system that has been trained using historical personal pressures representing detected falls, wherein the setting 660 of the fall detection alert is based also on whether said machine learning system classifies the personal pressure $P_P$ as a fall.

The machine learning system may be trained using historical personal pressures representing detected falls for the individual, or for many individuals. If the machine learning system has been trained using historical personal pressures representing detected falls for many individuals, the fall detection alert may be set based on the comparison of the personal pressure $P_P$ with the individual personal pressure profile, together with whether this machine learning system classifies the personal pressure $P_P$ as a fall based on historical personal pressures representing detected falls for many individuals. For this comparison, the personal pressure $P_P$ may first be normalized, e.g. by deducting the average and dividing by the standard deviation.

The determining 640 of the individual personal pressure profile may e.g. be based on the historical personal pressure $P_P$ of the individual, e.g. based on the probability distribution of the historical personal pressure $P_P$ of the individual, e.g. in such a way that personal pressure values $P_P$ that lie beyond the individual personal pressure profile have less than a predetermined probability of occurring. The predetermined probability of occurring may e.g. be 1-5%, such as e.g. 3%. The setting 660 of the fall detection alert may be based also on a signal from a movement sensor 230, e.g. an accelerometer, arranged in the personal module 200. The setting 660 of the fall detection alert may be based also on other parameters, such as the signal from a heart rate sensor 240 or a GPS receiver 250.

Since the personal pressure profile is individually determined, the claimed method compensates for variations in movement pattern between different individuals and between different houses or apartments, and thus reduces the number of false alarms.

The fall detection method 600 may further comprise:

Step 680: sending an alarm signal based on the fall detection alert.

The fall detection method 600 may further include communicating between the personal module 200 and the reference module 300 using a personal module communication interface 260 and a reference module communication interface 330.

The foregoing disclosure is not intended to limit the present invention to the precise forms or particular fields of use disclosed. It is contemplated that various alternate embodiments and/or modifications to the present invention, whether explicitly described or implied herein, are possible in light of the disclosure. Accordingly, the scope of the invention is defined only by the claims.

The invention claimed is:

1. A fall detection system comprising at least one processing device, at least one personal module comprising a personal module pressure sensor, and at least one reference module comprising a reference module pressure sensor, wherein the at least one processing device is arranged to:

receive personal pressure data from the at least one personal module pressure sensor;

receive reference pressure data from the at least one reference module pressure sensor;

determine a personal pressure using the personal pressure data and the reference pressure data;

determine an individual personal pressure profile based on the historical personal pressure of the individual;

compare the personal pressure ($P_P$) with the determined individual personal pressure profile; and set a fall detection alert based at least on whether the personal pressure lies beyond the individual personal pressure profile.

2. The fall detection system according to claim 1, wherein the individual personal pressure profile comprises an individual personal pressure threshold, and the at least one processing device is arranged to set the fall detection alert based at least on whether the personal pressure is above the individual personal pressure threshold.

3. The fall detection system according to claim 1, wherein the at least one processing device is further arranged to:

determine the personal pressure as an absolute personal pressure calculated based on the personal pressure data and the reference pressure data; and determine the individually determined personal pressure profile based on the historical absolute personal pressure of the individual.

4. The fall detection system according to claim 1, wherein the at least one processing device is arranged to determine the individual personal pressure profile based on the probability distribution of the historical personal pressure of the individual.

5. The fall detection system according to claim 1, wherein the at least one processing device is arranged to determine the individual personal pressure profile in such a way that personal pressure values that lie beyond the individual personal pressure profile have less than a predetermined probability of occurring.

6. The fall detection system according to claim 5, wherein the at least one processing device is arranged to set the predetermined probability of occurring to 1-5%.

7. The fall detection system according to claim 1, wherein the at least one processing device is further arranged to input the personal pressure into a machine learning system that has been trained using historical personal pressures representing detected falls, and set the fall detection alert based also on whether said machine learning system classifies the personal pressure as a fall.

8. The fall detection system according to claim 1, wherein the personal module further comprises a movement sensor, and the at least one processing device is further arranged to analyze the signal from the movement sensor and set the fall detection alert based also on this signal.

9. The fall detection system according to claim 1, wherein the processing device is further arranged to send an alarm signal based on the fall detection alert.

10. The fall detection system according to claim 1, wherein the personal module further comprises a personal module communication interface, and the reference module further comprises a reference module communication interface, which are arranged to communicate with each other.

11. The fall detection system according to claim 1, comprising a number of reference modules, wherein the at least one processing device is arranged to determine the personal pressure using reference pressure data from the reference module that is closest to the personal module.

12. A fall detection method, comprising:

receiving, in at least one processing device, personal pressure data from a personal module pressure sensor arranged in a personal module;

receiving, in the at least one processing device, reference pressure data from a reference module pressure sensor arranged in a reference module;

determining a personal pressure using the personal pressure data and the reference pressure data;

determining an individual personal pressure profile based on the historical personal pressure of the individual;

comparing the personal pressure with the individual personal pressure profile; and setting a fall detection alert based at least on whether the personal pressure lies beyond the individual personal pressure profile.

13. The fall detection method according to claim 12, wherein the individual personal pressure profile comprises an individual personal pressure threshold, and the setting of the fall detection alert is based at least on whether the personal pressure is above the individual personal pressure threshold.

14. The fall detection method according to claim 12, wherein the determining of the personal pressure comprises calculating the personal pressure as an absolute personal pressure based on the personal pressure data and the reference pressure data, and the determining of the individually determined personal pressure profile is based on the historical absolute personal pressure of the individual.

15. The fall detection method according to claim 12, wherein the determining of the individual personal pressure profile is based on the probability distribution of the historical personal pressure of the individual.

16. The fall detection method according to claim 12, wherein the individual personal pressure profile is determined in such a way that personal pressure values that lie beyond the individual personal pressure profile have less than a predetermined probability of occurring.

17. The fall detection method according to claim 16, wherein the predetermined probability of occurring is 1-5%.

18. The fall detection method according to claim 12, further comprising inputting the personal pressure into a machine learning system that has been trained using historical personal pressures representing detected falls, wherein the setting of the fall detection alert is based also on whether said machine learning system classifies the personal pressure as a fall.

19. The fall detection method according to claim 12, wherein the setting of the fall detection alert is based also on a signal from a movement sensor arranged in the personal module.

20. The fall detection method according to claim 12, further comprising sending an alarm signal based on the fall detection alert.

21. The fall detection method according to claim 12, further comprising communicating between the personal module and the reference module using a personal module communication interface and a reference module communication interface.

22. The fall detection method according to claim 12, wherein the determining of the personal pressure uses reference pressure data from the reference module that is closest to the personal module.

* * * * *